US005628533A

United States Patent [19]

Hill

[11] Patent Number: 5,628,533

[45] Date of Patent: May 13, 1997

[54] TORSIONAL SNAP-FIT LATCH

[75] Inventor: Mark G. Hill, Novi, Mich.

[73] Assignee: Yazaki Corporation, Tokyo, Japan

[21] Appl. No.: 546,822

[22] Filed: Oct. 23, 1995

[51] Int. Cl.[6] ..... E05C 19/06

[52] U.S. Cl. ..... 292/80; 292/DIG. 38

[58] Field of Search ..... 292/80, 83, 87, 292/91, 98, 19, DIG. 38; 220/4.21, 326, 281, 282

[56] References Cited

U.S. PATENT DOCUMENTS

| | | | |
|---|---|---|---|
| 4,688,836 | 8/1987 | Varlet | 292/91 |
| 5,361,925 | 11/1994 | Wecke et al. | 220/325 |
| 5,390,811 | 2/1995 | Ogino et al. | 220/326 |

FOREIGN PATENT DOCUMENTS

| | | |
|---|---|---|
| 3-88012 | 9/1991 | Japan . |
| 4-332486 | 11/1992 | Japan . |
| 4-135121 | 12/1992 | Japan . |

*Primary Examiner*—Steven N. Meyers
*Assistant Examiner*—Donald J. Lecher
*Attorney, Agent, or Firm*—Young & Basile, P.C.

[57] ABSTRACT

A snap-latch mechanism for releasably connecting two components comprises a male latch member extending from a first component and a female latch frame disposed on a second component. The latch frame defines a passageway through which the latch member is inserted, and the latch member undergoes a torsional deflection as it passes therethrough to achieve locking engagement with the latch frame. The torsional deflection is caused by two oppositely inclined ramp surfaces disposed on the interior of the lock frame to apply a camming action and rotate an enlarged head portion of the latch member as it passes through the passageway. When the head portion has passed completely through the frame, it is released from the ramp surfaces and the latch member returns to its undeformed configuration and is latchingly engaged with the latch frame. In a preferred embodiment, a fulcrum rib disposed on the second component simplifies manual actuation of the latch member back to the twisted configuration to release it from engagement with the latch frame.

9 Claims, 2 Drawing Sheets

TORSIONAL SNAP-FIT LATCH

FIELD OF THE INVENTION

This invention relates to snap-fit latching mechanisms for releasably securing two components together, and more specifically to such a mechanism in which a latching member undergoes torsional deflection in moving between latched and unlatched configurations.

BACKGROUND OF THE INVENTION

The term "snap-fit latch," as used herein, refers to mechanisms which use interengaging male and female latch elements disposed on relatively movable first and second components to detachably and repeatably secure the two components together. Examples are container/lid combinations. The two components may be hinged together or totally separate.

The components are joined by bringing the two of them into registry to place the male and the female latch elements in alignment with one another, followed by a step of urging the components together such that contact between the latch elements alters one or both of the elements from an undeformed, at-rest condition. The geometry of the male and female latch elements is such that when the two components reach a desired orientation relative to one another the altered latch element is allowed to snap back, due to its own elasticity, to a comparatively undeformed condition wherein it is engaged with its mating latch element.

The resulting mechanical engagement between the latch elements prevents the joined components from being separated until the latch elements are manipulated in a manner to permit them to be easily disengaged from one another. This is normally accomplished by manually urging one or both of the latch elements back to the same deformed condition that permitted the two elements to become engaged with one another.

Snap-fit latch mechanisms thus rely on the elastic behavior of the latch elements as well as the geometries of those elements to ensure proper functioning of the latch. If the latch elements are too stiff and/or the amount of deflection required for them to reach engagement is too high, the mechanism requires the application of a large amount of force to both engage and disengage the latch. This is usually undesirable because it makes the latch mechanism difficult to manually operate, and/or because the high stresses applied to the latch elements can, after repeated use, cause permanent deformation such that the elements will no longer mate securely. On the other hand, if the lock elements are not stiff enough or do not require much deflection to disengage, the result may be a latch mechanism that does not hold securely and/or is prone to inadvertent release during use of the components.

SUMMARY OF THE INVENTION

The present invention provides a snap-fit latch mechanism wherein: a) the mating elements of the latch mechanism are engagable with one another without the need to first align the elements precisely, b) a low insertion force is required to move the elements into latched engagement, c) the elements are subjected to relatively low stresses during actuation, d) the mechanism is easily manipulated to an unlatched condition, and e) the mechanism resists inadvertent or accidental opening.

The invention comprises two complementally interengaging elements: a male latch member extending from a first component and having an enlarged head portion at its distal end, and a complemental female latch frame disposed on a second component to define a passageway having an insertion end and an opposite locking end. To achieve a latched configuration, the head portion of the male latch member is placed in the insertion end of the latch frame and urged through the passageway to the locking end.

According to a feature of the invention, the passageway is wider at the insertion end than at the locking end and the internal surfaces of the latch frame constitute cam means. The increased width of the passageway at the insertion end permits the latch frame to receive the male latch member without the need for precise alignment between the two elements beforehand, and as the head portion passes through the passageway the cam means rotates the head portion to twist the male latch member about its longitudinal axis. When the head portion has passed completely through the latch frame to the locking end, it is released from the twisting means and the male latch member returns to its undeformed configuration. In this configuration, movement of the head portion back through the passageway is obstructed by contact with a locking surface at the locking end of the latch frame. The male latch member and the latch frame are thus in latched engagement with one another, and the male latch member can only be withdrawn from the latch frame by manually twisting it back to its twisted configuration.

According to another feature of the invention, the cam means comprises two oppositely inclined ramp surfaces protruding obliquely into the passageway. The ramp surfaces cooperate to narrow the passageway down from the greater insertion end width to the smaller latching end width, and simultaneously give the passageway the twisting shape which deflects the head portion as it passes therethrough.

According to yet another feature of the invention, the latch member head portion comprises two wings projecting laterally from a longitudinal axis of the latch member, and the latch mechanism further includes a fulcrum rib disposed on the second component in a position adjacent to the longitudinal axis of the latch member when the latch member is in latched engagement with the latch frame. By manually pressing one of the wings toward the second component, the longitudinal axis of the male latch member is brought into contact with the fulcrum and the head portion is thus caused to rotate about the fulcrum to move the latch member to the twisted configuration in which it may be released from engagement with the latching surface and withdrawn from the latch frame. The fulcrum thus permits the latch member to be twisted and released from the latch frame with only a simple pressing action on the latch member rather than a more difficult-to-apply rotating action.

According to still another feature of the invention, a transversely oriented retaining groove is formed in the latching surface of the latch frame. When the latch member is in its undeformed configuration and engaged with the latch frame, the upper edges of the wings are in close proximity with the groove so that any urging of the latch member back through the latch frame tends to seat the wings in the groove and so restrain the latching member against movement to its twisted configuration.

DETAILED DESCRIPTION OF THE PREFERRED EMBODIMENT

Figure 1:
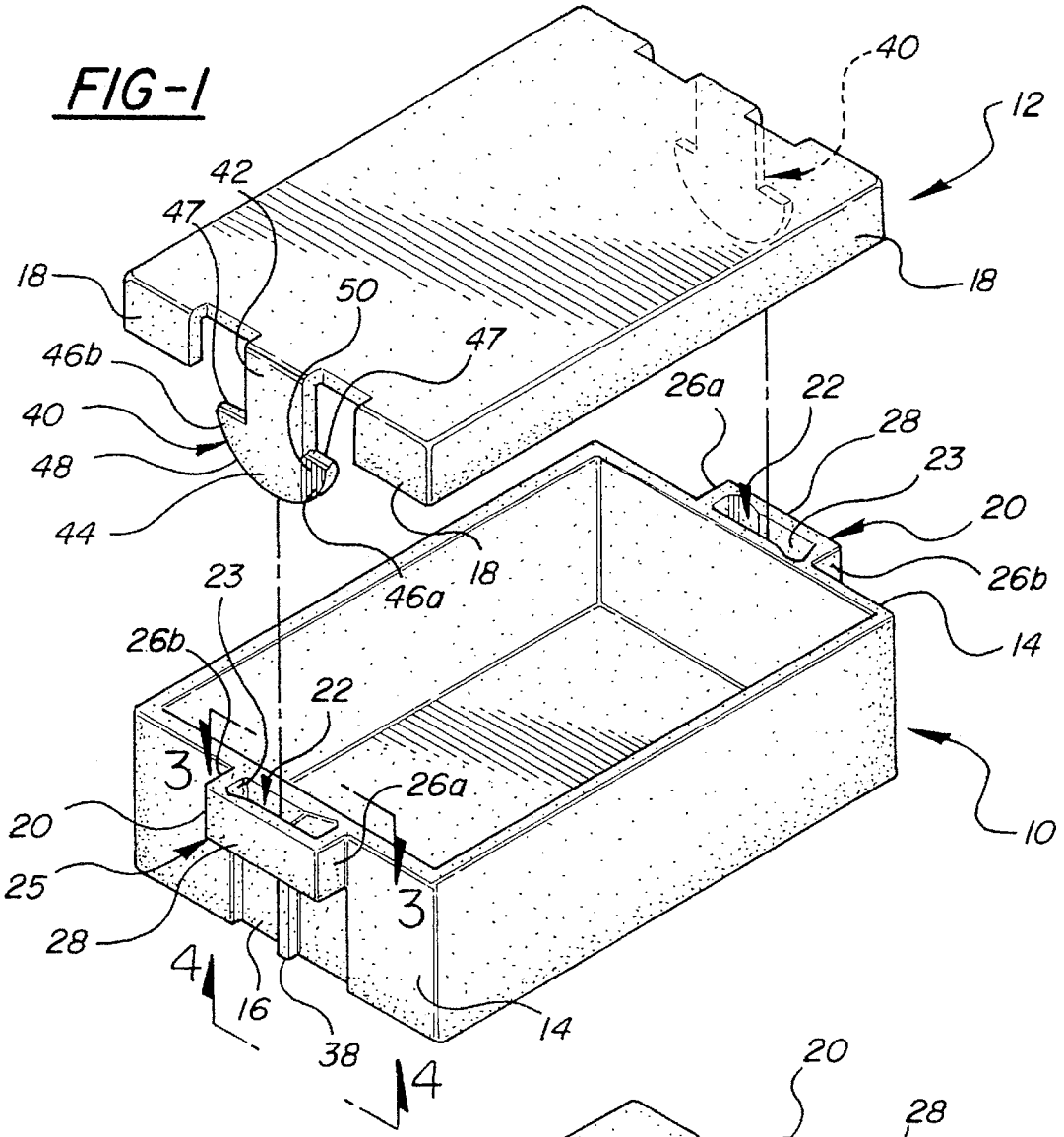
FIG. 1 is a perspective view of a box and a lid featuring a torsional snap-latch mechanism according to the invention.
Figure 2:
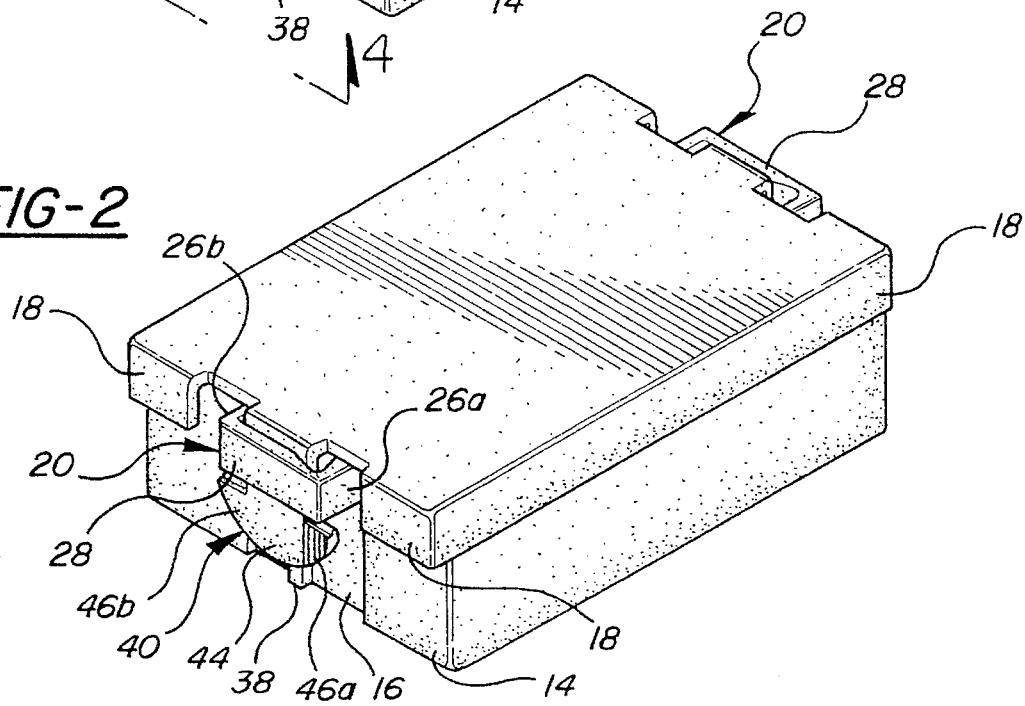
FIG. 2 is a perspective view of the box and lid of FIG. 1 in a joined condition.

FIGS. 1 and 2 depict a box 10 and a lid 12 adapted for mating connection with one another by means of a torsional snap-latch mechanism according to the present invention. Box 10 and lid 12 are preferably injection molded of a thermoplastic material such as polypropylene or the like.

Lid 12 has downwardly extending sidewalls 18 around substantially its entire perimeter, except in the vicinity of a pair of male latch members 40 disposed on opposite edges of the lid. Latch members 40 are of a substantially uniform thickness, and each comprises a neck portion 42 defining a downwardly extending longitudinal axis and a head portion 44 located at the end of the neck distal from the lid. Head portion 44 comprises a pair of wings 46*a*, 46*b* which project laterally outward on opposite sides of the longitudinal axis of neck portion 42 to lie in a plane substantially parallel with that of the neck portion. Head portion 44 has a substantially straight top edge 47 and a curved bottom edge 48, giving it an overall semicircular shape. A plurality of raised ridges 50 are formed on the outer surface; i.e., the surface facing away from lid 12, of wing 46*a* of each head portion 44.

Box 10 has a pair of female latch frames 20 molded integrally therewith, one frame projecting outwardly from each of two opposite faces 14 of the box. Latch frames 20 each comprise a pair of parallel side bars 26*a*, 26*b* extending from face 14 and a front bar 28 connecting the side bars and parallel with face 14. A recess 16 is formed in each face 14 immediately below each lock frame 20 and is approximately the same width as the frame. A vertical fulcrum rib 38 runs along the center of recess 16 between latch frame 20 and the bottom of box 10.

Figure 3:
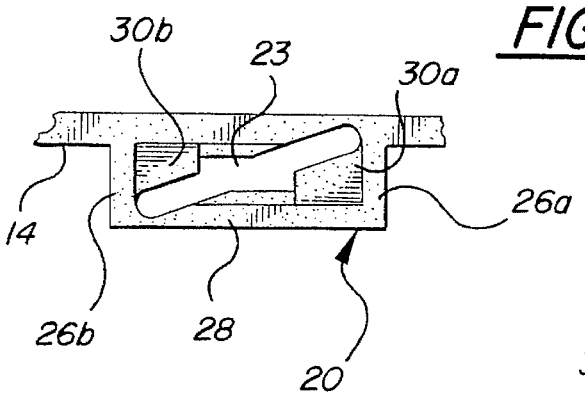
FIG. 3 is a view taken along line 3—3 of FIG. 1.
Figure 4:
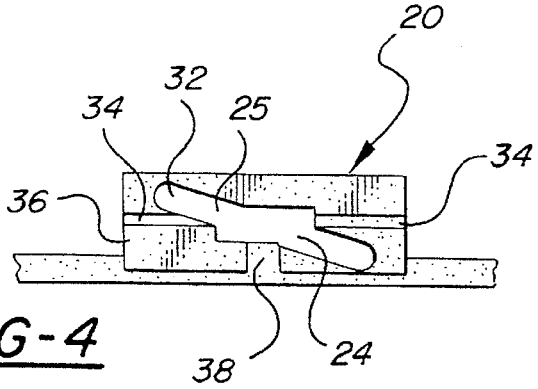
FIG. 4 is a view taken along line 4—4 of FIG. 1.

Each latch frame 20 defines a vertically oriented passageway 22 having between an upper insertion end 23 and a lower latching end 25. At insertion end 23, passageway 22 has a width, as measured perpendicular to face 14, at least twice and preferably three or four times as great as the thickness of latch member 40. As best seen in FIGS. 3 and 4, a pair of downwardly and inwardly sloping ramps 30*a*, 30*b* are formed in the interior of latch frame 20. Ramp 30*a* projects from front bar 28 at a position adjacent side bar 26*a*, and ramp 30*b* projects form face 14 at a position adjacent side bar 26*b*. The obliquely sloping surfaces of ramps 30*a*, 30*b* intrude into passageway 22 so that the passageway tapers from a relatively wide and generally rectangular shape at its insertion end 23 to a narrower and irregular shape at its latching end 25.

The shape of passageway 22 at latching end 25 comprises a centrally located neck slot 24 and an elongated wing slot 32 cutting through the neck slot at an angle such that the ends of the wing slot are adjacent diagonally opposite corners of latch frame 20. Neck slot 24 and wing slot 32 both are only slightly wider than the thickness of latch member 40. The lower end of latch frame 20 adjacent latching end 25 constitutes a latching surface 36, and a shallow retaining groove 34 extends transversely across the latching surface as seen in FIG. 4.

To join box 10 and lid 12, the two components are positioned so that latch members 40 are in general alignment with their respective latch frames 20, and the box and lid are moved toward each other to urge the latch members downwardly into passageways 22. Since latch frames 20 are of a width several times greater than the thickness of latch members 40, precise alignment between the latch members and latch frames is not required prior to inserting the members into the frames. As each latch member 40 moves into the passageway 22 defined by its respective latch frame 20, bottom edge 48 of head portion 44 and the surfaces of wings 46*a*, 46*b* come into interfering contact with ramps 30*a*, 30*b* which act as cams to apply a moment to the latch member and twist it about its longitudinal axis. Latch member 40 is twisted from an undeformed configuration wherein it is substantially parallel with face 14 to a twisted configuration wherein head portion 44 is aligned with wing slot 32.

Figure 5:
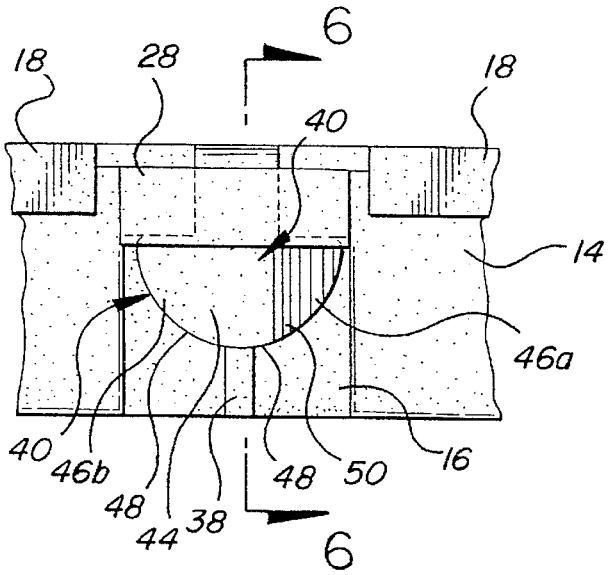
FIG. 5 is a front elevation view of the box and lid of FIG. 2.
Figure 6:
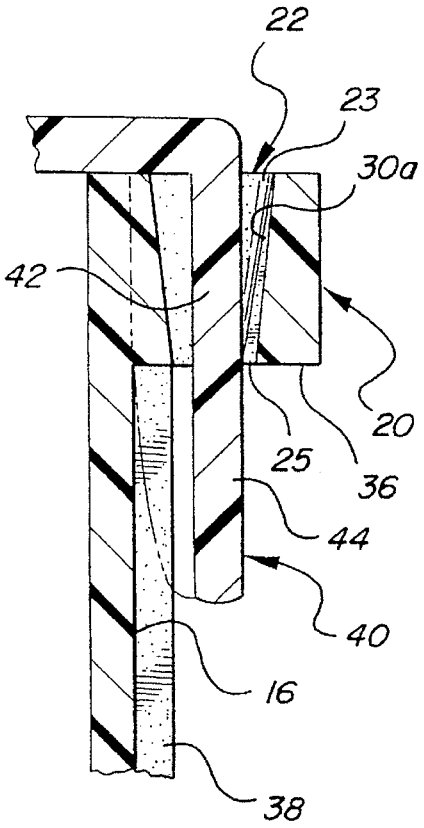
FIG. 6 is a cross-sectional view taken along line 6—6 of FIG. 5.

The relative longitudinal lengths of neck portion 42 and latch frame 20 are such that when lid 12 and box 10 are in their fully mated condition shown in FIGS. 2, 5 and 6, head portion 44 is completely through to the latching side of latch frame 20 and is clear of wing slot 32. At this point, head portion 44 is released from latch frame 20 so that the twisting moment is no longer applied to latch member 40. The elasticity of the latch member material causes it to snap back to its undeformed configuration in which the head portion is substantially parallel with the surface of recess 16 and with retaining groove 34. Latch member 40 is thus latched into engagement with latch frame 20 and any attempt to move the latch member back upward through the frame is resisted by physical interference between head portion top edges 47 and latching surface 36.

When latch member 40 and latch frame 20 are in latched engagement, any upward urging of head portion 44, caused for example by an attempt to separate box 10 and lid 12, tends to seat top edges 47 in retaining groove 34. This engagement restrains head portion 44 against rotation, thereby minimizing the possibility that the head portion will inadvertently become aligned with wing slot 32 so as to allow the head portion to be withdrawn from the frame.

To release latch member 40 from mated engagement with latch frame 20, head portion 44 must be rotated about the longitudinal axis of the latch member to place it in alignment with wing slot 32. This rotation is accomplished by pressing wing 46*a* toward the surface of recess 16 so that head portion 44 contacts and pivots about fulcrum rib 38, moving wing 46*b* away from recess 16. Fulcrum rib 38 thus makes release of the latch mechanism easier to accomplish, since without the pivoting effect it provides release could only be achieved by simultaneously pressing inward on wing 46*a* and pulling outward on wing 46*b*. Note that ridges 50 are formed only on wing 46*a* to provide a visual and tactile indicator of which side of head portion 44 must be pressed to effect a release of the lock mechanism.

Because of the small amount of twisting deflection required to move latch member 40 between the undeformed configuration and the twisted configuration, the amount of stress experienced by the lock member is well below the elastic limit of most thermoplastics commonly used to manufacture components of this type. Accordingly, the latch member will not take on a permanent set nor break, even after repeated latching and unlatching.

Also as a result of the small deflection required to actuate latch member 40, only a small amount of force need be applied to insert latch member 40 through latch frame 20. The act of twisting the latch member back to the position required to unlock the pieces is also greatly simplified, particularly so with the provision of fulcrum rib 38.

It will be appreciated that the drawings and descriptions contained herein are merely meant to illustrate a particular embodiment of the present invention and are not meant to be limitations upon the practice thereof, as numerous variations will occur to persons of skill in the art. For example, although the invention is described above as a latch mechanism joining a box with a lid, it is to be understood that the invention may also be practiced in relation to a mechanism used to join any two components that it is desired to releasably attach to one another.

I claim:

1. First and second components in combination with a latch mechanism for releasably and repeatably securing the first component to the second component, the latch mechanism comprising:

a male latch member having a neck portion extending from the first component along a longitudinal axis and a distal head portion comprising two wings projecting laterally from the lonqitudinal axis, the male latch member having a substantially planar undeformed configuration and being resiliently urgable to a twisted configuration wherein the head portion is rotated to twist the latch member about its longitudinal axis;

a female latch frame disposed on the second component for receiving the male latch member, the latch frame defining a passageway for receiving the male latch member therethrough and having an insertion end of a first width and an opposite latching end of a second width smaller than the first width, the female latch frame having internally disposed cam means for rotating the head portion to move the male latch member to its twisted configuration as the head portion passes from the insertion end to the latching end of the passageway and for releasing the head portion to allow the male latch member to return to its undeformed configuration wherein the male latch member is in latched engagement with the female latch frame; and a fulcrum disposed on the second component in a position to be adjacent to the lonqitudinal centerline of the latch member when the latch member is in latched engagement with the latch frame whereby forcing one of the wings toward the second component brinqs the longitudinal centerline of the latch member into contact with the fulcrum, rotates the head portion about the fulcrum, and moves the latch member to the twisted confiquration.

2. A latching mechanism according to claim 1 wherein the female latch frame is substantially rectangular and the cam means comprises:

a first ramp surface disposed adjacent a first side of the female latch frame and protruding into the passageway in a first direction; and a second ramp surface disposed adjacent a second side of the female latch frame opposite the first side and protruding into the passageway in a second direction substantially opposite the first direction.

3. A latch mechanism according to claim 1 wherein the fulcrum comprises a rib oriented substantially parallel with the longitudinal axis of the latch member when the latch member is in latched engagement with the latch frame.

4. A latch mechanism according to claim 1 wherein the latch frame further has an external latching surface adjacent the latching end, the latching surface having a transversely oriented retaining groove engagable with the wings to restrain the latching member against movement to its twisted configuration.

5. A latching mechanism according to claim 1 wherein the two wings have differently textured surfaces to provide visual and tactile differentiation between the two wings.

6. First and second components in combination with a latch mechanism for releasably securing the first component to the second component, the latch mechanism comprising:

a male latch member having a neck portion extending from the first component along a longitudinal axis and a distal head portion, the latch member having an undeformed configuration and being movable to a twisted configuration wherein the latch member is twisted about the longitudinal axis;

a female latch frame disposed on the second component and defining an internal passageway having an insertion end, an opposite latching end and internally disposed cam means for rotating the head portion and moving the latch member to its twisted configuration as the head portion passes from the insertion end to the latching end of the passageway and for releasing the head portion after the head portion has passed substantially completely through the passageway to the latching end, the release of the head portion allowing the latch member to return to its undeformed configuration wherein the latch member is in latched engagement with the latch frame; and a fulcrum disposed on the second component adjacent to the position of the head portion when the latch member is in latched engagement with the latch frame, whereby the head portion may be rotated about the fulcrum to move the latch member to the twisted configuration.

7. A latch mechanism according to claim 6 wherein the cam means comprises two opposingly inclined ramp surfaces disposed at opposite sides of the lock frame and protruding into the passageway.

8. A latch mechanism according to claim 6 wherein the fulcrum comprises a rib oriented substantially parallel with the longitudinal axis of the latch member when the latch member is in latched engagement with the latch frame.

9. A latch mechanism according to claim 6 wherein the latch frame further has an external latching surface adjacent the latching end, the latching surface having a transversely oriented retaining groove engagable with the head portion to restrain the latching arm against movement to its twisted configuration when the latch member is in latched engagement with the latch frame.

* * * * *